US007007948B2

(12) United States Patent
Kamiya et al.

(10) Patent No.: US 7,007,948 B2
(45) Date of Patent: Mar. 7, 2006

(54) SHEET STACKING/ALIGNING APPARATUS, SHEET HANDLING APPARATUS, AND IMAGE FORMING APPARATUS

(75) Inventors: Daisaku Kamiya, Chiba (JP); Mitsushige Murata, Chiba (JP); Hiromichi Tsujino, Ibaraki (JP); Yuzo Matsumoto, Ibaraki (JP); Takako Hanada, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 10/784,950

(22) Filed: Feb. 25, 2004

(65) Prior Publication Data

US 2004/0201165 A1 Oct. 14, 2004

(30) Foreign Application Priority Data

Feb. 28, 2003 (JP) ..... 2003-054416
Mar. 3, 2003 (JP) ..... 2003-055257

(51) Int. Cl.
*B65H 37/04* (2006.01)

(52) U.S. Cl. ..... 271/221; 270/58.12; 270/58.16; 270/58.17

(58) Field of Classification Search ..... 271/220, 271/221, 222; 270/58.11, 58.12, 58.16, 58.17
See application file for complete search history.

(56) References Cited

U.S. PATENT DOCUMENTS 3,749,398 A * 7/1973 Fujita et al. ..... 271/180
5,535,012 A 7/1996 Matsumoto et al. ..... 358/400
5,580,045 A 12/1996 Matsumoto et al. ..... 271/298
5,761,600 A 6/1998 Murata ..... 399/403
6,120,020 A * 9/2000 Asao ..... 271/189
6,196,542 B1 * 3/2001 Allmendinger ..... 271/189
6,219,503 B1 4/2001 Miyake et al. ..... 399/85
6,246,491 B1 6/2001 Matsumoto et al. ..... 358/468
6,353,726 B1 3/2002 Murata et al. ..... 399/407
6,371,472 B1 4/2002 Miyake et al. ..... 270/58.14
6,386,080 B1 5/2002 Okamoto et al. ..... 83/73
6,471,429 B1 10/2002 Isobe et al. ..... 400/582
6,647,243 B2 11/2003 Sato et al. ..... 399/407
6,671,491 B1 12/2003 Yamanaka et al. ..... 399/407
2002/0129690 A1 9/2002 Yaginuma et al. ..... 83/628
2003/0044186 A1 3/2003 Kato et al. ..... 399/16
2003/0049063 A1 3/2003 Suzuki et al. ..... 399/407
2003/0214090 A1 11/2003 Kato et al. ..... 270/12
2003/0235448 A1 12/2003 Nemura et al. ..... 399/389
2004/0070141 A1 * 4/2004 Michels et al. ..... 271/220

FOREIGN PATENT DOCUMENTS

JP 2002179322 A * 6/2002
JP 2003335449 A * 11/2003

* cited by examiner

*Primary Examiner*—Patrick Mackey
(74) *Attorney, Agent, or Firm*—Fitzpatrick, Cella, Harper & Scinto

(57) ABSTRACT

In order to reduce the stack failure of a sheet bundle, there is provided a sheet stacking/aligning apparatus comprising: a stack tray for stacking sheets thereon; and a rear end aligning member for pushing and aligning the rear end of a sheet conveyed onto the stack tray. The rear end aligning member includes sheet holding paddle for holding the sheets stacked on the stack tray.

7 Claims, 14 Drawing Sheets

SHEET STACKING/ALIGNING APPARATUS, SHEET HANDLING APPARATUS, AND IMAGE FORMING APPARATUS

BACKGROUND OF THE INVENTION

1. Field of the Invention

The present invention relates to a sheet stacking/aligning apparatus having a sheet rear end aligning member for pushing and aligning the rear end of a sheet.

2. Description of the Related Art

In the image forming apparatus of the related art such as a printer, a copying machine or a printer, as shown in FIG. 8, sheets S having images formed in an image forming apparatus body 300 are temporarily stacked on a handling tray 140 in an image forming apparatus body 100, in which the sheets S are subjected to a handling operation such as to a aligning operation or a stapling operation. After this, the sheet bundle of the handled sheets is discharged by bundle discharge means.

The discharged sheet bundle is stacked on a stack tray 400 having a sloped stack face, and the sheets S discharged in the bundle move on the sloped stack face of the stack tray 400 by their own weights and are aligned at their rear ends on a rear end aligning wall 401. The number of stacked sheets depends on the vertical running stroke of the stack tray 400. On the other hand, the stack tray 400 having the sloped stack face needs a height for the slope. The sheet handling apparatus 100 mounted in the image forming apparatus, as shown in FIG. 8, is restricted in its height so that it cannot have a sufficient number of stacks.

In case the bundle is to be discharged to a horizontal tray, on the other hand, there has been known a technique, in which the sheet bundle is conveyed and stacked by the bundle discharge means such as a gripper to and on a stack tray having a horizontal stack face. If the gripper technique is mounted as the bundle discharge means, however, its complicated mechanism enlarges the size of the entire image forming apparatus and raises the cost.

In order to solve these problems, there has been a sheet handling apparatus 1, which is provided with a sheet stacking/aligning apparatus for stacking a sheet bundle on a generally horizontal stack tray 4 by turning a rear end aligning wall 70, as shown in FIG. 9 and FIGS. 10A to 10D. The sheet stacking/aligning apparatus: conveys the sheet bundle till the rear end of the sheet bundle reaches the upper end of the rear end aligning wall 70 (FIG. 10B); turns and inclines the rear end aligning wall 70 with a cam 72 to bring the rear end of the sheet bundle into abutment against the side end of the rear end aligning wall 70 (FIG. 10C); and then stacks the sheet bundle on the gently inclined stack tray 4 (FIG. 10D) while turning the rear end aligning wall 70 in a returning direction to push the rear end of the sheet bundle with the side end of the rear end aligning wall 70 thereby to align the sheet bundle in the conveyance direction. As a result, the displacement at the front end and rear end in the sheet bundle conveyance direction can be prevented to improve the stack alignment of the sheet bundle on the stack tray 4 and to spare the space.

In case a sheet bundle curled upward is to be stacked, as shown in FIG. 11, however, the sheet stacking/aligning apparatus of the related art has a problem that the stack height is reduced in the extent of the curl (i.e., the height L in FIG. 11).

Even without the curl, moreover, the thickness of the sheet bundle is enlarged by the air layers between the sheets in the sheet bundle thereby to reduce the number of stacked sheets. If the number of stacked sheets is to be retained, on the other hand, there arises a problem that the apparatus is accordingly enlarged to retain the vertical working stroke of the tray.

Moreover, the rear end of the sheet bundle, which is discharged to ride on a driven roller 71 due to the curl, collides against the sheet bundle to be next handled, and the stack fault may be caused by pushing the sheet bundle in the discharge direction.

At the time of rocking the rear end aligning wall 70, on the other hand, the sheet bundle leans against the rear end aligning wall 70 and cannot be aligned thereby to cause the stack fault.

SUMMARY OF THE INVENTION

The present invention has been conceived in view of the related art thus far described, and has an object to provide a sheet stacking/aligning apparatus, a sheet handling apparatus and an image forming apparatus, which can arrange the rear end of a sheet bundle with a reduced stack fault.

In order to achieve the above-specified object, according to the invention, there is provided a sheet stacking/aligning apparatus comprising: stack means for stacking sheets thereon; and sheet rear end aligning means for pushing and aligning the rear end of a sheet conveyed onto the stack means, wherein the sheet rear end aligning means includes sheet holding means for holding the sheets stacked on the stack means.

In order to achieve the aforementioned object, moreover, according to the invention, there is provided a sheet handling apparatus comprising: intermediate handling means for temporarily stacking a sheet conveyed from sheet conveyance means to handle the sheet; stack means for stacking the sheets handled; sheet rear end aligning means capable of moving selectively to a support position, at which it supports the lower face of the sheet bundle handled by the intermediate handling means, or an escape position at which it escapes from the lower face of the sheet bundle to drop the sheet bundle onto the stack means; control means for changing the position of the sheet rear end aligning means between the support position and the escape position; and sheet holding means for holding the rear end portions of the sheets stacked on the stack means, wherein the control means makes controls so that it may cooperate to perform the sheet rear end aligning operation by the sheet rear end aligning means for moving from the escape position to the support position to align the rear end of the sheet bundle dropped on the stack means and the sheet holding operation by the sheet holding means.

According to the aforementioned construction, the timing for the sheet rear end aligning means to arrange the sheet rear ends on the stack means and the timing for the sheet holding means to hold the sheets can be synchronized, and these two operation can be done in parallel so that the handing time period can be shortened.

It is preferable that the pushing force by the sheet holding means changes in accordance with the change in the rate of the sheet rear end aligning operation by the sheet rear end aligning means.

According to the aforementioned construction, in case the horizontal velocity component of the sheet rear end aligning operation of the sheet rear end aligning means is large, the rear end of the sheet is prevented from leaving the sheet rear end aligning means by increasing the sheet pushing force at the sheet holding means, even if the sheet is excessively vigorously pushed by the sheet rear end aligning means.

It is preferable that the sheet holding means generates a pushing force to push the sheet toward the sheet rear end aligning means, after the sheet rear end aligning means began to push the rear end of the sheet.

According to the aforementioned construction, the sheet rear end aligning means does not abut with the sheet bundle while the sheet bundle having unaligned rear ends being held, so that the sheet rear ends are not folded.

It is preferable that the sheet holding operation by the sheet holding means are started at an earlier timing than that of the end of the sheet rear end aligning operation by the sheet rear end aligning means, and that the sheet holding operation by the sheet holding means are ended at a timing simultaneous with or later than that of the end of the sheet rear end aligning operation by the sheet rear end aligning means.

According to the aforementioned construction, the uppermost sheet of the sheet bundle is not excessively returned, even if the paper is firm, by the sheet holding means from the state, in which the sheet rear ends are aligned by the sheet rear end aligning means, so that the sheets can be prevented from being wrinkled or folded.

It is preferable that the sheet handling apparatus further comprises a drive unit for driving the sheet rear end aligning means and the sheet holding means with common drive means.

It is preferable that the drive unit includes: a rocking shaft for transmitting the rotation of the drive means to support the sheet rear end aligning means in a rocking manner; a rotary shaft for supporting the sheet holding means rotatably; and drive transmission means for transmitting the rotation of the rocking shaft to the rotary shaft, and that the sheet rear end aligning means is rocked according to the rotation of a cam portion included by the rotary shaft.

According to the aforementioned construction, the sheet rear end aligning means and the sheet holding means are synchronized in the simple construction by one drive means so that the sheet rear end aligning operation and the sheet holding operation can be cooperated with each other.

Moreover, the sheet handling apparatus described above can be suitably adopted in an image forming apparatus comprising image forming means for forming an image on a sheet to be conveyed to the sheet handling apparatus.

DETAILED DESCRIPTION OF THE PREFERRED EMBODIMENTS

[First Embodiment]

The image forming apparatus according to the invention will be described in connection with its embodiments with reference to the accompanying drawings.

Figure 1:
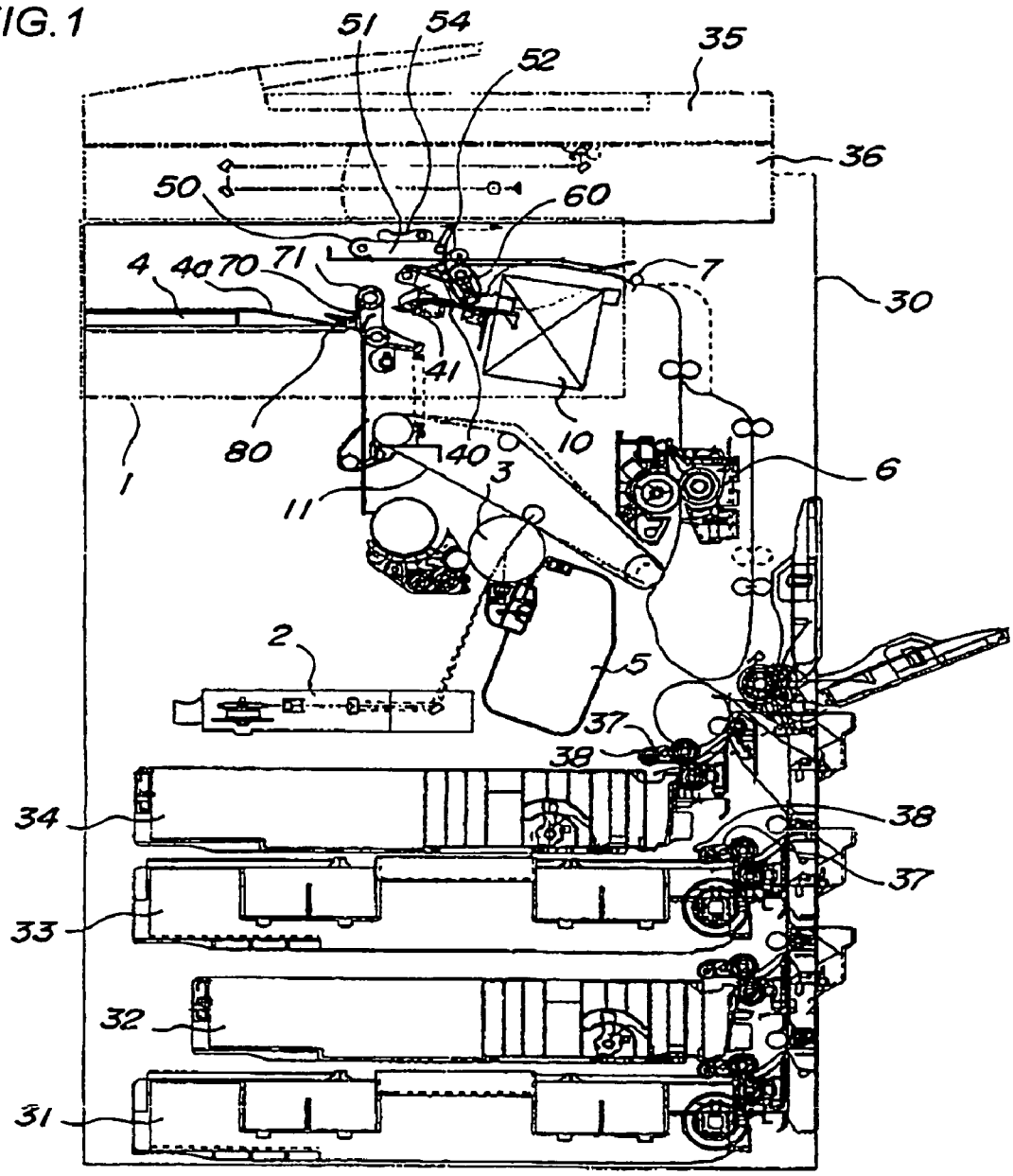
FIG. 1 is a sectional view of an image forming apparatus according to a first embodiment.
Figure 3A:
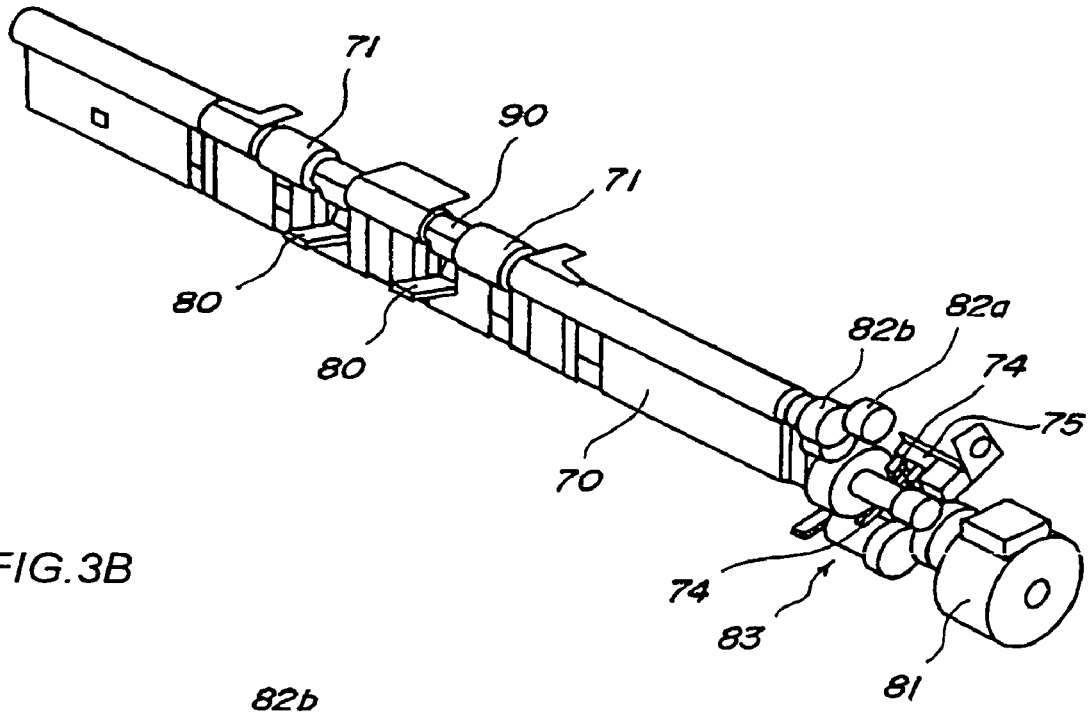
FIGS. 3A and 3B are construction diagrams of a sheet stacking/aligning apparatus according to the first embodiment.
Figure 3B:
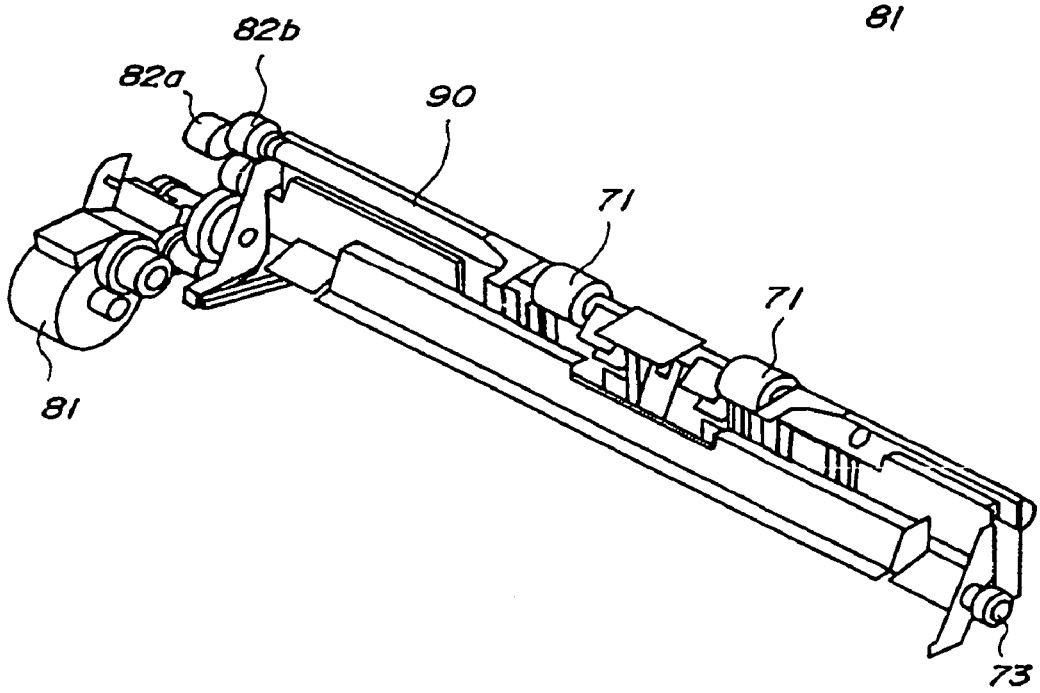

FIG. 1 is a sectional view of an image forming apparatus body mounted with a sheet stacking/aligning apparatus according to a first embodiment of the invention, and FIGS. 3A and 3B are perspective views of the sheet stacking/aligning apparatus. FIGS. 4A to 4E, 5A to 5B and 6A to 6E are explanatory diagrams of the sheet stacking/aligning operation.

(Entire Construction)

In the image forming apparatus, as shown in FIG. 1, there are arranged an automatic document read apparatus 35, a document read unit 36, a sheet handling apparatus 1 having the sheet stacking/aligning apparatus, and an image forming apparatus body 30.

Here, the invention is also effective for either an image forming apparatus, in which the sheet handling apparatus 1 is omitted but the sheet stacking/aligning apparatus is connected directly to the image forming apparatus body 30, or an image forming apparatus, which is provided with the sheet handling apparatus 1 outside of its body 30.

The automatic document read apparatus 35: separates the upward set documents upward; feeds the documents leftward one by one sequentially from the leading page; conveys the document onto a platen glass through a curved path; reads the documents on the platen glass; and then discharges the document to a discharge tray.

The document is read by irradiating it with a beam coming from the lamp of the document read unit 36 and by guiding the light reflected from the document into an image sensor through a mirror. The image of the document read by the image sensor is subjected to an image treatment and is sent to an exposure control unit 2, and a laser beam is emitted.

The laser beam irradiates a photosensitive drum 3 having a homogeneously charged surface to act as image forming means thereby to form an electrostatic latent image. This electrostatic latent image on the photosensitive drum 3 is developed by a developer 5 and is transferred to an intermediate transfer belt 11.

On the other hand, the sheets S made of paper, an OHP sheet or the like are let suitably and selectively off any of sheet cassettes 31 to 34 by a pickup roller 38 constructing sheet feed means, and separated by separation means 37 and fed one by one. Then, the sheets S are corrected from oblique positions by a pre-registration roller pair, and then sent to a transfer position in synchronism with of the rotate of the intermediate transfer belt 11. Then, the toner image transferred to the intermediate transfer belt 11 is transferred to the sheets S.

The sheet S having the toner image transferred thereto is guided into a fixing roller pair of a fixing device 6. The toner image is subjected to heating and pressing treatments by the fixing roller pair so that the toner image is permanently fixed to the sheets S. The sheets S having the toner image fixed thereto are guided by a body side discharge roller pair 7 into the sheet handling apparatus 1, which is connected to the image forming apparatus body 30.

(Sheet Handling Apparatus)

The sheet handling apparatus will be specifically described in the following.

In FIG. 2, the sheet handling apparatus 1 is provided with a handling tray 40 arranged on the upstream side to act as sheet stacking means, a staple unit 10, a rocking roller 50 and the sheet stacking/aligning apparatus. The sheet handling apparatus 1 is performs the sheet handlings to staple or align the sheets S discharged from the body side discharge roller pair 7 of the image forming apparatus body 30, at the handling tray 40.

The sheet handling mode to be done in the handling tray 40 includes a sort mode for sorting a plurality of sheet bundles, and a stapling mode for stapling a plurality of sheets with the staple unit 10, and is selected and set by the not-shown setting means before the job is started. Here, the stapling position can be selected between a one stapling position and two stapling positions, and the staple unit 10 moves, for the one stapling position or the like, to the actual stapling position in accordance with the set contents such as the sheet size or the stapling position.

The rocking roller 50 is attached to a rocking arm 51, which can rock in the vertical directions on a rocking roller shaft 52. When the not-shown rocking arm drive motor rotates, moreover, a rocking cam 54 rotates on a rocking arm shaft 53 so that the rocking arm 51 rocks in the vertical directions on the rocking roller shaft 52 together with the rocking cam 54.

On the other hand, the rocking roller 50 is connected to the rocking roller shaft 52 through the not-shown rocking roller drive belt and the rocking roller follower pulley and the rocking roller shaft 52 is connected to the rocking roller drive motor, so that the rocking roller 50 rotates when a drive signal is transmitted from a CPU of the sheet handling apparatus 1 through a rocking roller drive motor driver to the rocking roller drive motor.

The home position of the rocking roller 50 is located at the position, which is kept away from abutment against the sheet S discharged onto the handling tray 40 by the body side discharge roller pair 7 (FIG. 1). When the sheet S is discharged from the body side discharge roller pair 7, the rocking arm 51 is turned counter-clockwise on the rocking roller shaft 52 by the drive of the rocking arm drive motor. As a result, the rocking roller 50 descends to push the rear end of the sheet S thereby to drop the sheet rear end portion into the handling tray 40.

The rocking roller 50 forms a nip together with a driven roller 71 and rotates counter-clockwise with the drive of the rocking roller drive motor thereby to pull the sheet S backward of the conveyance direction till then until the rear end of the sheet S on the handling tray 40 comes into abutment against a return belt 60. After this, the rocking roller 50 ascends again to the home position and prepares itself for the discharge of the next sheet S.

The return belt 60 is supported to rotate vertically by the discharge roller shaft 63*a* and is usually set at a portion to contact with the sheet S on the handling tray 40. The return belt 60 is so constructed as to rotate on a return belt pulley 64 supported by a discharge roller 63. The return belt 60 transfer, when the discharge roller shaft 63*a* rotates counter-clockwise, the sheet S while abutting against a sheet rear end stopper 62. Moreover, the return belt 60 can move in the thickness direction of the sheets S stacked on the handling tray 40, in accordance with the number of sheets.

Thus, by the counter-clockwise turns of the rocking roller 50 and the return belt 60, the rear ends of the sheets S are positioned at the end portion of the handling tray 40 and are conveyed to the sheet rear end stopper 62 for accepting the sheets S on the handling tray 40 so that the sheets S are aligned one by one in the sheet conveyance direction.

On the other hand, the alignment of the sheets S in the sheet widthwise direction is performed such that a front aligning plate 41 (FIG. 1) and the rear aligning plate (although not shown) move to the alignment positions with respect to one side, a center or the like thereby to pinch the sheets S. In case the stapling mode is selected, the widthwise aligning operation are performed at the position according to the set stapling position.

In case the stapling mode is selected, the sheet aligning operation are accompanied by the stapling operation. The staple unit 10 is enabled to move in the longitudinal directions by the drive of the staple clinch motor. When the job is started, the staple unit 10 moves to the actual stapling position, which is indexed from the contents of the stapling position set before the job start and from the sheet size. The staple unit 10 staples the aligned sheet bundle S having finished the widthwise alignment.

(Sheet Stacking/Aligning Apparatus)

As shown in FIG. 2, the sheet stacking/aligning apparatus includes: a stack tray 4 arranged in a generally horizontal position downstream of the handling tray 40 and acting as stack means; a rear end aligning wall 70 acting as sheet rear end aligning means; and a sheet holding paddle 80 acting as sheet holding means. The sheet stacking/aligning apparatus aligns the sheet bundle having the sheets handled in the handling tray 40, and stacks the sheet bundle on the stack tray 4.

Figure 2A:
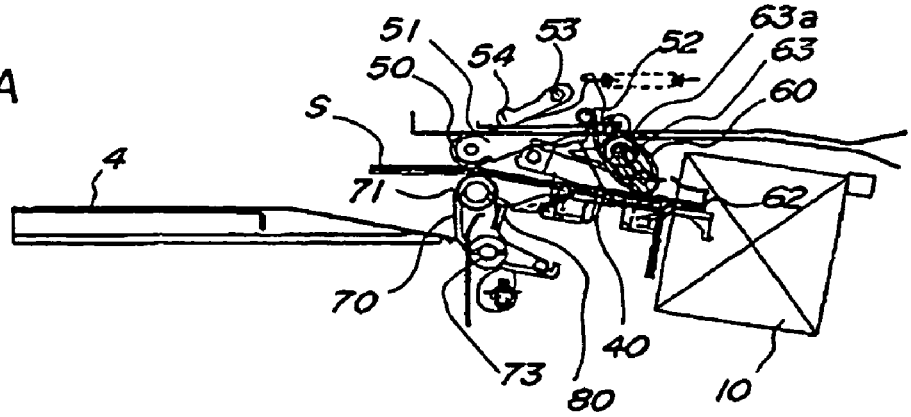
FIGS. 2A to 2D are explanatory diagrams of a sheet handling apparatus according to the first embodiment.
Figure 2B:
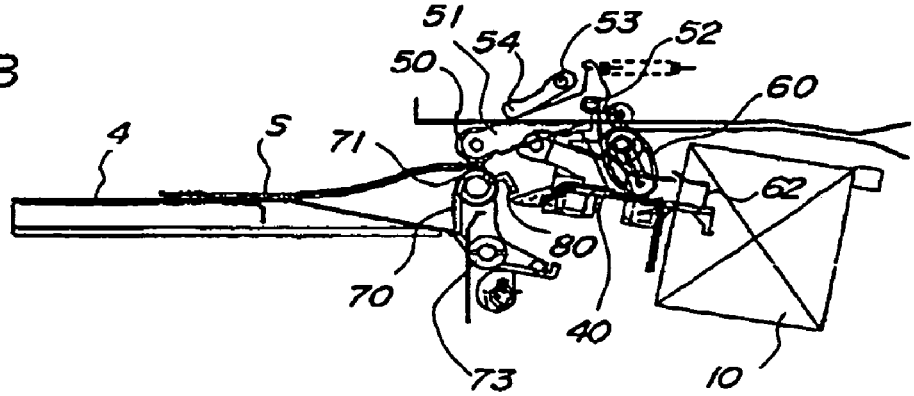

After the ends of the alignment in the sheet conveyance direction, the alignment in the sheet widthwise direction and the stapling operation, the rocking roller 50 descends on the rocking roller shaft 52 with the drive of the rocking arm drive motor till it abuts against the sheet bundle S, thereby to form the nip with the driven roller 71. After this, the rocking roller 50 rotates clockwise to transfer the sheet bundle S till this rear end reaches the vicinity of the upper end of the rear end aligning wall 70, and to stop the sheet bundle S (FIGS. 2A and 2B).

Figure 2C:
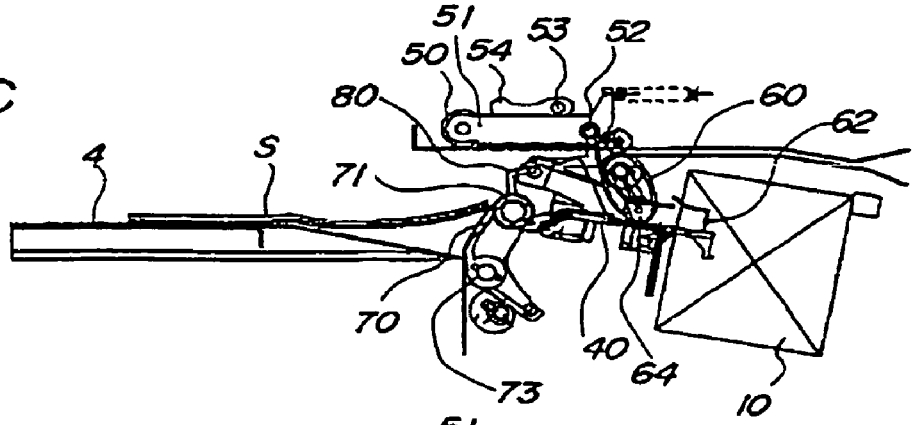
Figure 2D:
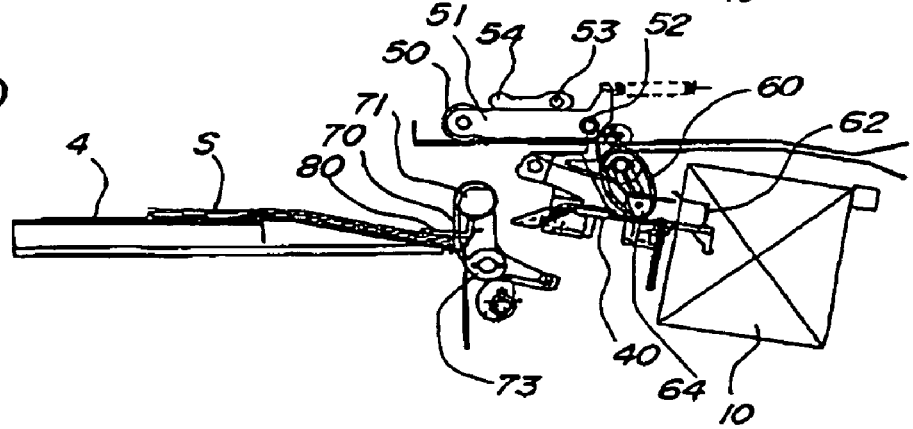

After this, the rocking roller 50 leaves the sheet bundle S and returns to the home position, and the rear end aligning wall 70 is once rocked backward of the sheet conveyance direction on a cam rocking shaft 73 by the later-described cam portion 82*a* and cam rail 86, which are driven by a paddle motor 81 (FIG. 3), thereby to drop the rear end of the sheet bundle S, and is then rocked again in the sheet conveyance direction thereby to align the rear end of the sheet bundle (as shown in FIGS. 2C and 2D).

As shown in FIG. 3, the rear end aligning wall 70 is rotatably supported on the shaft 73 and supports the sheet holding paddle 80 and a paddle turning shaft 90 rotatably through a bearing portion.

The sheet holding paddle 80 is arranged integrally with the paddle turning shaft 90 and is turned by the drive of the paddle motor 81 acting as the drive source through drive transmission means 83 (or individual gears) and a gear 82*b*. The sheet holding paddle 80 is desirably made of an elastic material such as rubber, and is desired to have a weight of 10 g to 60 g and a frictional coefficient $\mu$ of 0.2 or more so that it may not pull back the sheet more than necessary.

As shown in FIGS. 4A to 4E, the gear 82*b* has a cam portion 82*a* for revolving like a satellite about the gear 82*b* as the gear 82*b* rotates. The cam rail 86 arranged in the device has a cam rail face 86*a* for engaging with the cam portion 82*a*, and is so biased by the not-shown spring that the cam portion 82*a* and the cam rail face 86*a* may abut against each other.

Moreover, a sensor flag 74 for turning together with the gear on the shaft 73 and a sensor 75 detect the positional state between the sheet holding paddle 80 and the rear end aligning wall 70.

Figure 4A:
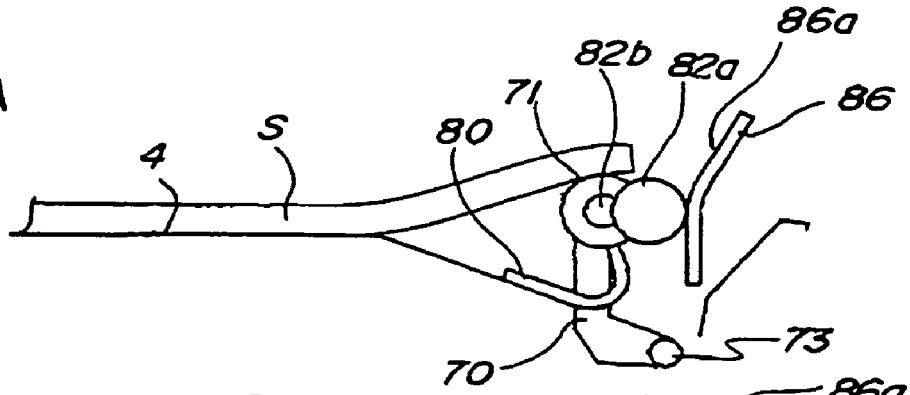
FIGS. 4A to 4E are explanatory diagrams of the sheet stacking/aligning apparatus according to the first embodiment.

Here are described the (cooperative) operation, in which the rear end aligning wall 70 and the sheet holding paddle 80 turn in synchronism with each other. Before the action start, as shown in FIG. 4A, the rear end aligning wall 70 is arranged in a generally vertical position (i.e., 0 degrees) and then takes a moving velocity of 0. On the other hand, the sheet holding paddle 80 is directed downward. Here, the sheets S lies on the sheet holding paddle 80 so that the sheet pushing pressure by the sheet holding paddle 80 is 0 (as referred to FIG. 12).

Figure 4B:
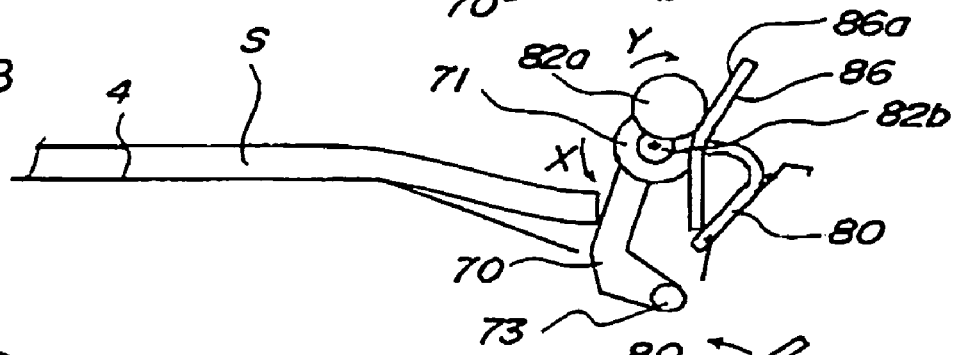

FIG. 4B is a diagram showing the state, in which the drive is transmitted so that the sheet-holding paddle 80 begins to turning in the direction of arrow X. The cam portion 82*a* revolves about the gear 82*b*, and the rear end aligning wall 70 is turned on the shaft 73 in the direction of arrow Y by the spring so that the cam portion 82*a* revolves along the cam rail face 86*a*. The horizontal component of the moving velocity of the rear end aligning wall 70 at this time is directed in the Y-direction but not in the direction to snap the sheet bundle S toward the stack tray 4. Therefore, the sheet pushing force is not generated yet by the sheet holding paddle 80.

Figure 4C:
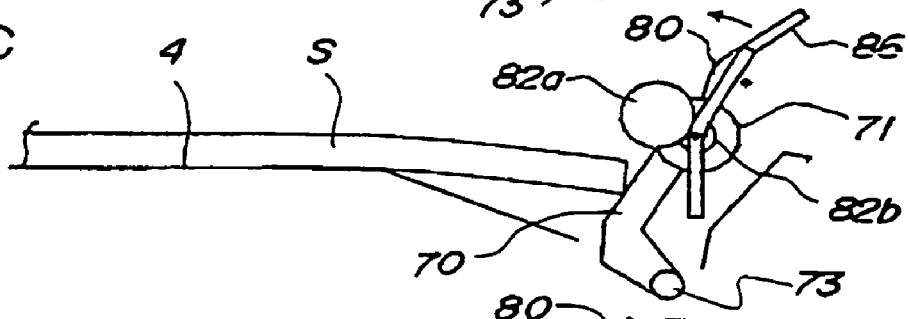

FIG. 4C shows the state, in which the rear end aligning wall 70 has completely escaped. The rear end aligning wall 70 has the maximum angle and a moving velocity of 0 in this case. On the other hand, the sheet holding paddle 80 is directed upward (as referred to FIG. 12). At this time, the sheet holding paddle 80 is so synchronized with the rear end aligning wall 70 as to keep the shown angle so that it is kept out of contact with the sheet bundle S. This state can be achieved by the aforementioned cam mechanism and bending cam rail face, as shown, into the optimum shape.

Figure 4D:
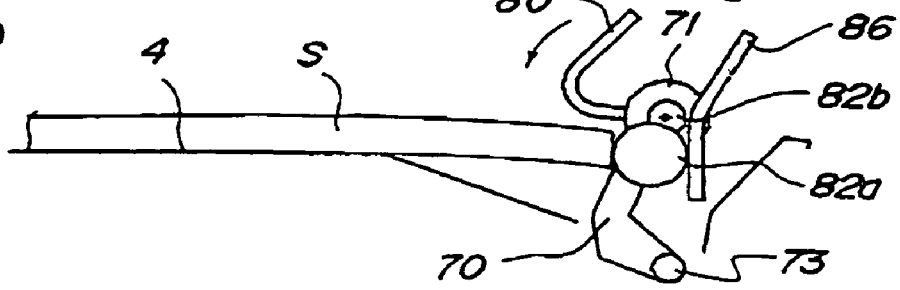

FIG. 4D shows the state, in which the sheet holding paddle 80 turns more. In this state, the rear end aligning wall 70 begins to be turned in the direction to push the sheet bundle by the cam portion 82*a* and the cam rail face 86*a* so that the rear end of the sheet bundle is aligned downstream of the conveyance direction by the rear end aligning wall 70. After the rear end aligning wall 70 began to turn in the direction to push the sheet bundle, the sheet holding paddle 80 comes into abutment of the upper face of the sheet bundle and returns the discharged sheet bundle so that the rear end of the sheet bundle may abut against the rear end aligning wall 70 while being held in the curled rear end.

From this point of time, the horizontal component of the moving velocity of the rear end aligning wall 70 is directed toward the stack tray 4. From this state, therefore, the sheet pushing force begins to be established by the sheet holding paddle 80 (as referred to FIG. 12). This sheet pushing force increases with the turns of the sheet holding paddle 80. The sheet rear end is pushed out toward the stack tray 4 by the rear end aligning wall 70 but is gradually pushed downward by the sheet holding paddle 80 so that the paper will not leave the rear end aligning wall 70.

Till the sheet holding paddle 80 ends the turning motion completely, on the other hand, there is room for the sheets to escape toward the stack tray 4, so that the sheet rear end is not folded.

Figure 4E:
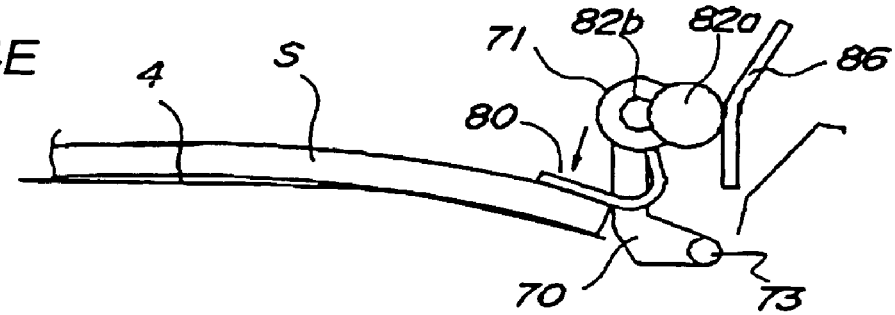
Figure 5A:
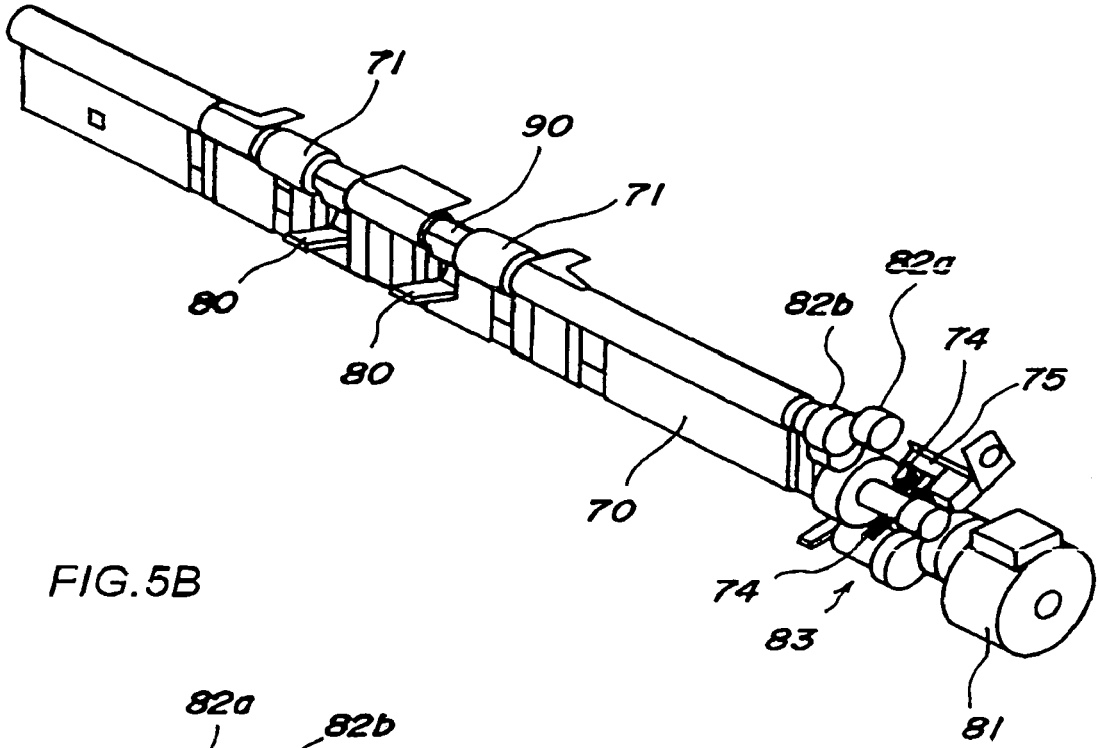
FIGS. 5A and 5B are construction diagrams of a sheet stacking/aligning apparatus according to the second embodiment.
Figure 5B:
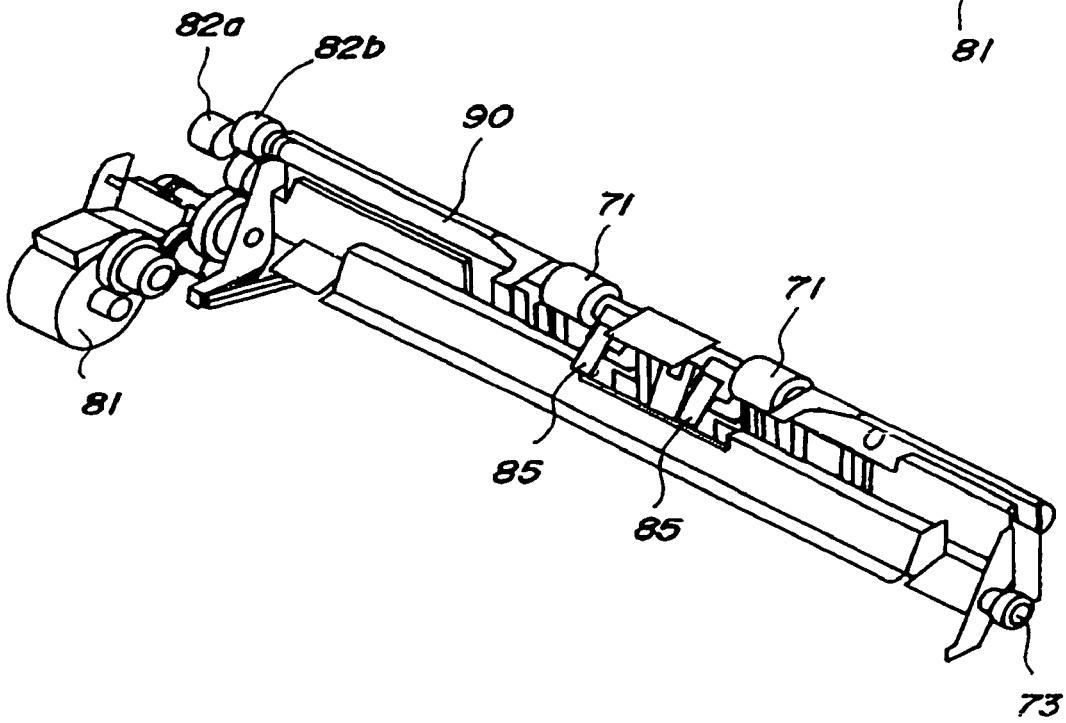
Figure 12:
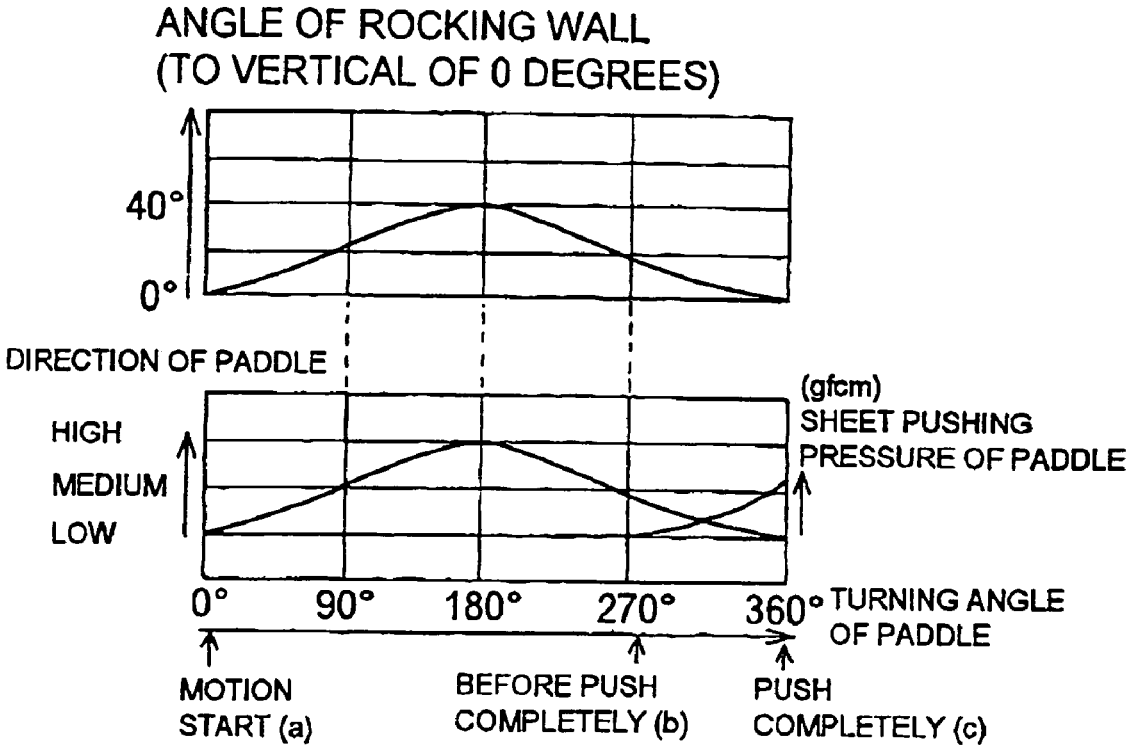
FIG. 12 presents schematic diagrams showing a positional relation between a rear end aligning wall and a paddle, and a timing and a change of a sheet pushing force in accordance with the embodiments.

FIG. 4E shows the state, in which the synchronous operation between the sheet holding paddle 80 and the sheet rear end aligning wall 70 are ended so that the rear end alignment of the sheet bundle, the sheet return and the sheet bundle holding are completed. The rear end alignment of the sheet bundle is completed simultaneously with the sheet return and the sheet bundle holding, or the sheet bundle holding is completed with a delay due to the elastic deformation of the sheet holding paddle 80. This sheet holding paddle 80 is directed again downward, and the rear end aligning wall 70 returns to and stops at the generally vertical position (of 0 degrees). The pushing force of the sheets S in this state by the sheet holding paddle 80 takes the maximum (FIG. 12).

Figure 11:
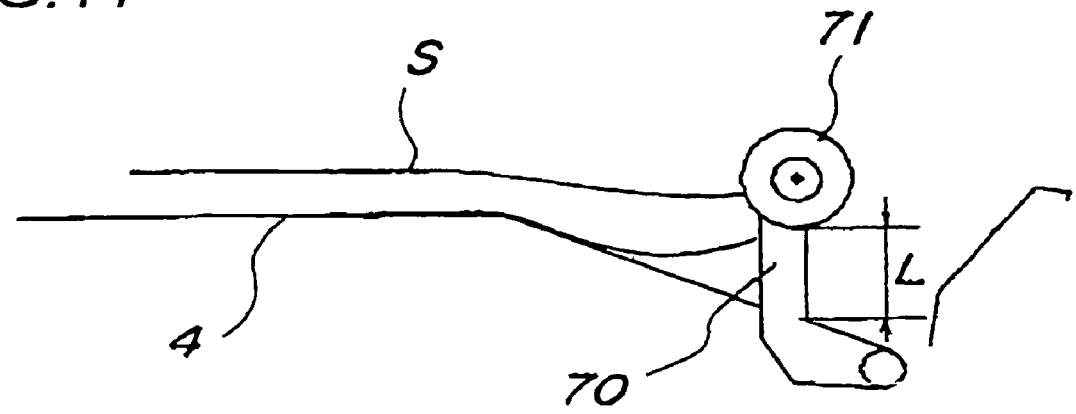
FIG. 11 is an explanatory diagram of the sheet stacking/aligning apparatus of the related art.

As thus far described, the sheet holding paddle 80 belonging to the sheet rear end aligning wall 70 holds the sheet bundle on the stack tray from the upward direction so that it can flatten the bundle curled upward. Also, the air layer between sheets can be flattened. As a result, the height of a clearance L by the curl, as shown in FIG. 11, is not lost as a space.

In case the sheets are left on the upper face of the driven roller 71 or in case the sheet rear end being aligned by the sheet rear end aligning wall 70 leans against the rear end aligning wall 70, moreover, the sheets can be discharged without fail onto the stack tray 4 by the sheet holding paddle 80.

Still moreover, the sheet rear end aligning wall 70 and the sheet holding paddle 80 are so synchronously timed that their relative positions may perform satisfactory sheet bundle aligning operation.

On the other hand, the stack tray 4 is so constructed that it can be moved up and down by the not-shown drive means to keep the upper face of the stacked sheet bundle S at a constant height.

In this embodiment, the sheet stacking face 4*a* of the stack tray 4 is set substantially horizontal but may be inclined. In case the sheet stacking face 9*a* is inclined, it can make the alignment of the sheet bundle more reliable. By setting the sheet stacking face 4*a* downward by 22 degrees or less toward the sheet rear end aligning wall, on the other hand, the sheet handling apparatus 1 and the image forming apparatus 30 can be small-sized while avoiding the interference between the rear end of the sheet bundle stacked on the stack tray 4 and the succeeding sheet bundle discharged from the handling tray 40.

This embodiment has been described on the stacking and alignment of the sheet bundle, but the sheet stacking/aligning apparatus can also be used for the stacking and alignment of the sheets.

(System Block Construction)

Figure 14:
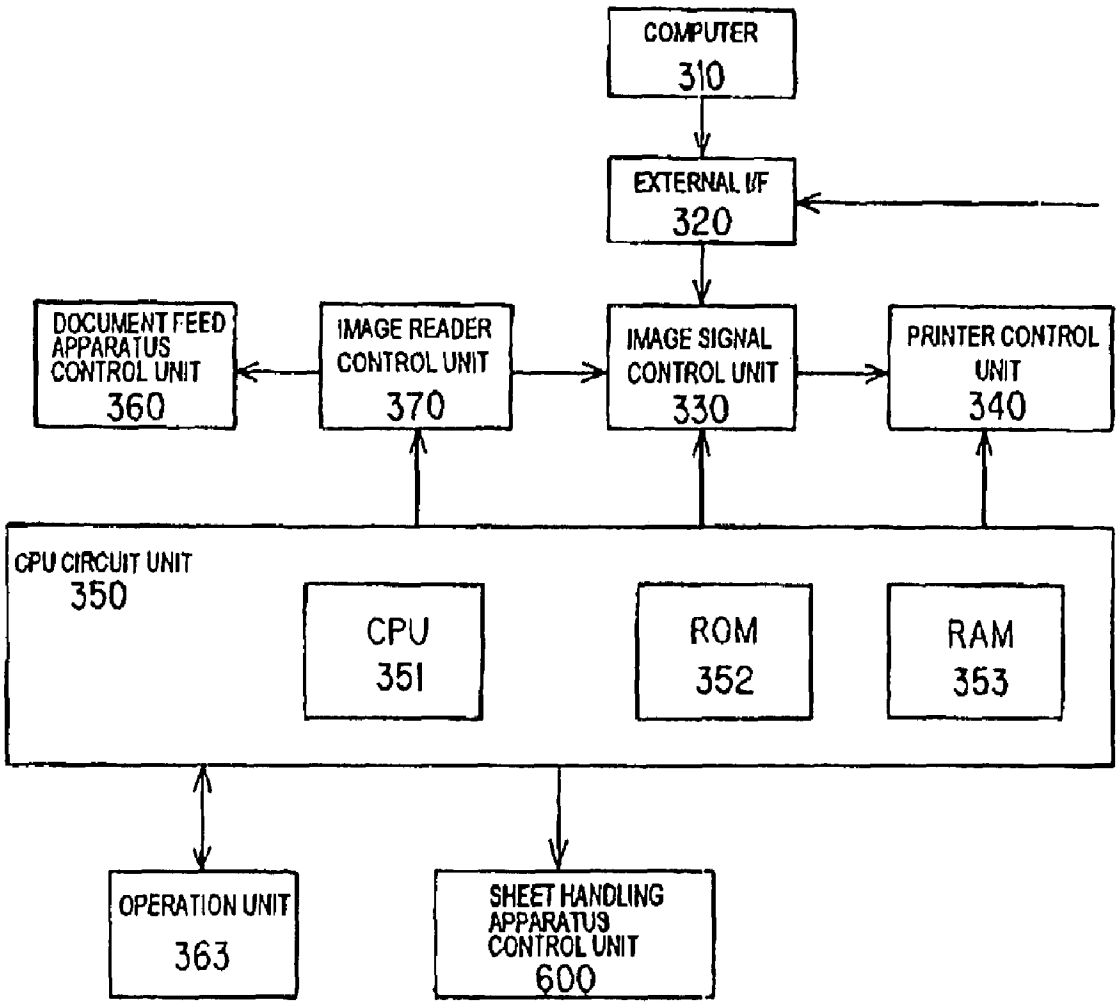
FIG. 14 is a block diagram showing a construction of a controller for controlling the image forming apparatus according to the embodiments.

Next, the construction of a controller for controlling the image forming apparatus as a whole will be described with reference to FIG. 14. FIG. 14 is a block diagram showing the construction of a controller for controlling the image forming apparatus according to the embodiment.

As shown in FIG. 14, the controller is provided with a CPU circuit unit 350, which has a CPU 351, a ROM 352 and a RAM 353 packaged therein. The CPU circuit unit 350 is so operated by the control programs stored in the ROM 352 as to control the individual blocks of an external I/F 320, an image signal control unit 330, a printer control unit 340, the RAM 353, a document feed apparatus control unit 60, an image reader control unit 370 and the sheet handling apparatus control unit 600 generally.

The RAM 353 is used as a work area for holding the control data temporarily and for the operations accompanying the controls.

The document feed apparatus control unit 360 drives and controls the document read apparatus 36 on the basis of an instruction from the CPU circuit unit 350.

The image reader control unit 370 drives and controls the scanner unit, and an image sensor 109 and so on, and conveys an analog image signal outputted from the image sensor 109, to the image signal control unit 330.

The image signal control unit 330 transforms the analog image signal from the image sensor 109 into a digital signal and subjects the digital signal to individual processings. The image signal control unit 330 transforms the digital signal into a video signal and outputs the video signal to the printer control unit 340. Moreover, the image signal control unit 330 subjects a digital image signal inputted from a computer 310 through the external I/F 320, to various processings, and transforms the digital image signal into a video signal and outputs the video signal to the printer control unit 340. These processing operation by the image signal control unit 330 are controlled by the CPU circuit unit 350.

On the basis of the video signal inputted, the printer control unit 340 drives the aforementioned exposure control unit (or the laser scanner unit) 2.

An operation unit 363 is provided with a plurality of keys for setting the various functions relating to the image formation, and a display unit for displaying the information indicating the set state. The operation unit 363 outputs a key signal corresponding to each key operation, and displays the corresponding information in the display unit on the basis of the signal from the CPU circuit unit 350.

The sheet handling apparatus control unit 600 is mounted on the sheet handling apparatus 1, and exchanges the information with the CPU circuit unit 350 to drive and control the sheet handling apparatus as a whole. These control contents will be described hereinafter. Here, the construction may be modified such that the sheet handling apparatus control unit 600 is disposed on the side of the image forming apparatus body 300 to drive and control the sheet stacking/aligning apparatus and the sheet handling apparatus.

(Sheet Handling Apparatus Block Diagram)

Figure 13:
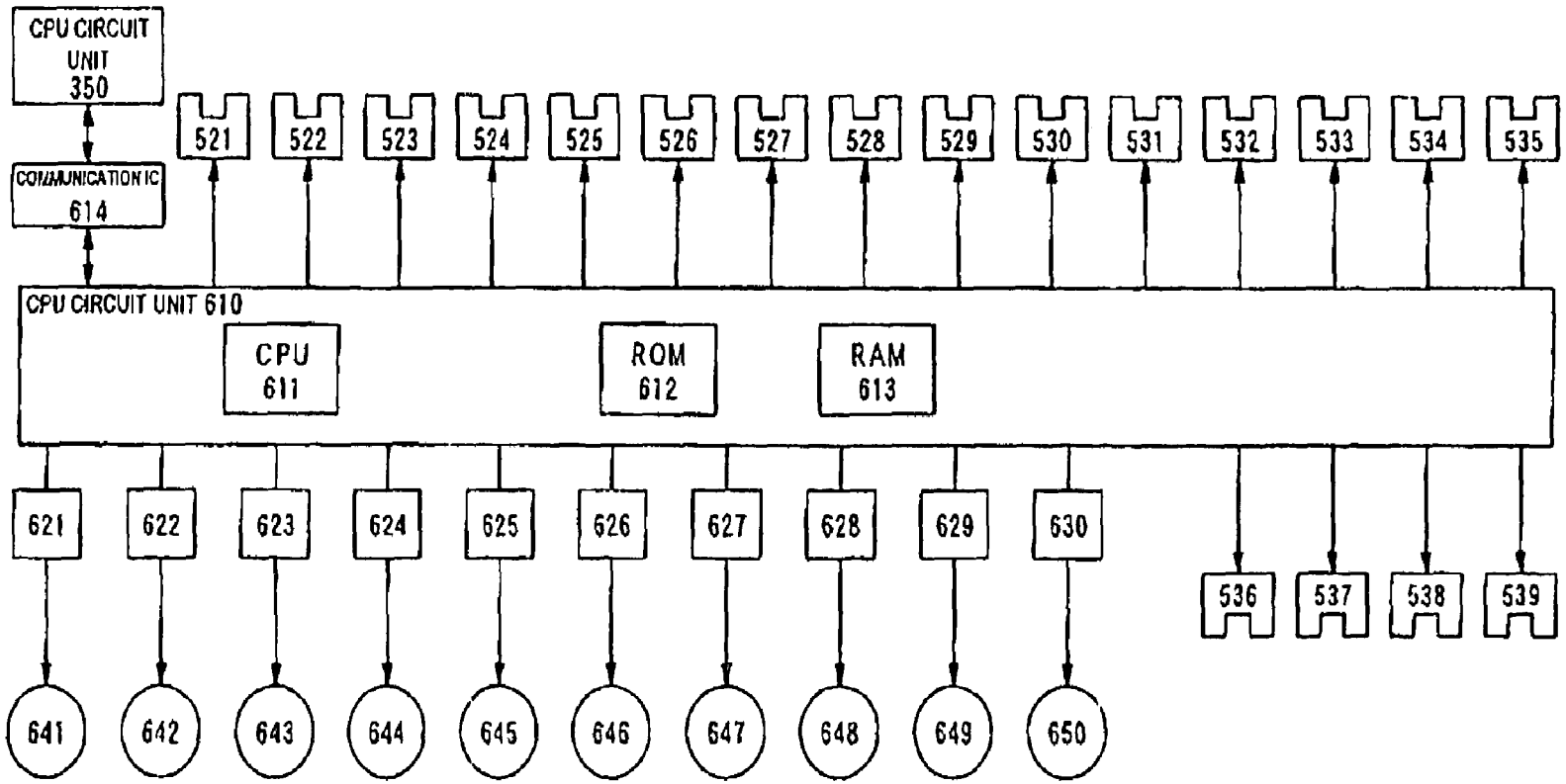
FIG. 13 is a block diagram illustrating a control unit of the sheet handling apparatus according to the embodiments.

Next, the construction of the sheet handling apparatus control unit 600 for driving and controlling the sheet handling apparatus 1 will be described with reference to FIG. 13. FIG. 13 is a block diagram showing the construction of the sheet handling apparatus control unit according to the embodiment.

As shown in FIG. 13, the sheet handling apparatus control unit 600 is provided with a CPU circuit unit 610 including the CPU 611, a ROM 612 and a RAM 613. The CPU circuit unit 610 communicates for data exchanges with the CPU circuit unit 350 disposed on the side of the image forming apparatus body 300 through a communication IC 614, and executes the various programs stored in the ROM 612, on the basis of an instruction from the CPU circuit unit 350 thereby to drive and control the sheet handling apparatus 1.

Upon these drive controls, the CPU circuit unit 610 fetches detection signals from various sensors.

These various sensors are exemplified by an entrance sensor 521, a rocking home position sensor 522, the rocking duckboard home position sensor 523, a tray detection sensor 524, a paper face detection sensor 525, a return belt escape sensor 526, a staple slide home position sensor 527 and a staple clinch home position sensor 528.

To the CPU circuit unit 610, there are connected the drivers 621 to 630 of the individual motors, which drive the motors on the basis of signals from the CPU circuit unit 610.

Here, the motors include: a discharge motor 641 acting as drive sources for an entrance transfer roller pair and the return belt 60; the rocking roller drive motor 642 for performing both the drive to return the sheets conveyed by the entrance transfer roller pair, with the rocking roller 50 attached to the leading end of the rocking arm 51, and the drive to discharge the sheet bundle handled on the handling tray 40 to the stack tray 4; the rocking arm drive motor 643 acting as a drive source for driving the rocking arm 51 in the vertical directions so as to catch the rear end portion of the sheets discharged to the handling tray 40; a paddle motor 645 acting as both the drive source for driving the rear end aligning wall 70 so as to align the rear end of the sheet bundle discharged onto the stack tray 4 and the drive source for the sheet holding paddle 80 or the holding member to hold the rear end portion of the sheet bundle stacked on the stack tray 4; a front alignment motor 646 and a rear alignment motor 647 acting as a drive source for aligning the sheets stacked on the handling tray 40, perpendicularly of the sheet conveyance direction; a staple clinch motor 648 acting as a drive source for the stapling operation of the staple unit 10; a staple slide motor 649 acting as a drive source for driving the staple unit 10 in the longitudinal directions; and a stack tray motor 650 acting as a drive source for the stack tray 4.

The discharge motor 641, the rocking roller drive motor 642, the rocking arm drive motor 643, the paddle motor 645, the front alignment motor 646, the rear alignment motor 647 and the staple slide motor 649 are made of stepping motors, so that they are enabled to rotate the roller pairs driven by the individual motors, at constant velocities or at different velocities by controlling them at an excitation pulse rate.

On the other hand, the discharge motor 641, the rocking roller drive motor 642, the rocking arm drive motor 643, the front alignment motor 646, the rear alignment motor 647 and the staple slide motor 649 can be activated forward and backward by a discharge motor driver 621, the rocking roller drive motor driver 622, a rocking arm drive motor driver 623, a front alignment motor driver 626, a rear alignment motor driver 627 and a staple slide motor driver 629, respectively.

The staple clinch motor 648 and the stack tray motor 650 are made of DC motors.

[Second Embodiment]

The present invention will be described in connection with a second embodiment of the sheet stacking/aligning apparatus with reference to the accompanying drawings. The description on the portions overlapping those of the foregoing first embodiment is omitted by designating them by the common reference numerals.

In the sheet stacking/aligning apparatus according to this embodiment, as shown in FIG. 5, a scraper member 85 acting as sheet scraping means is aligned with the sheet holding paddle 80 of the sheet stacking/aligning apparatus according to the first embodiment so that it may be able to turn together with the paddle turning shaft 90.

Figure 7:
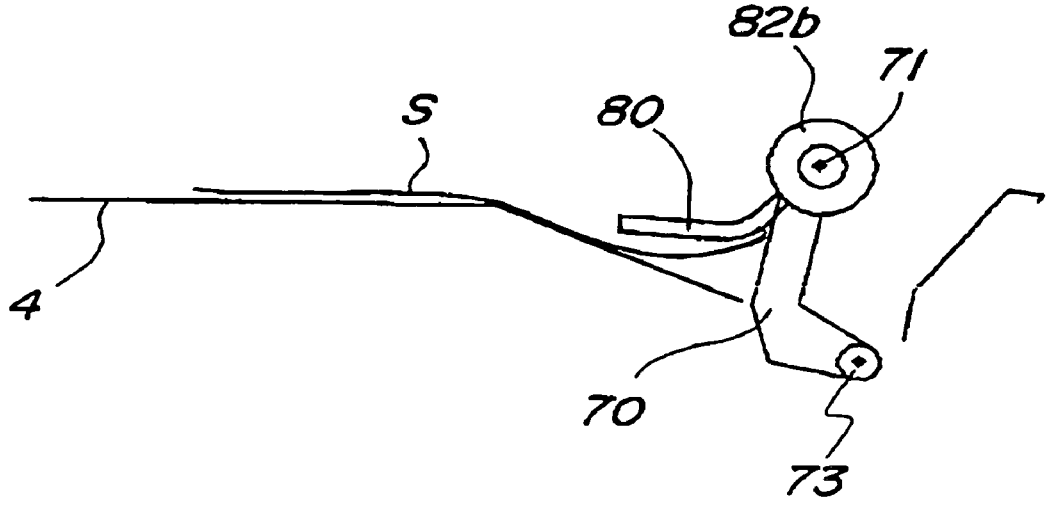
FIG. 7 is an explanatory diagram of a sheet bundle alignment by a paddle and a rear end aligning wall according to the first embodiment.
Figure 8:
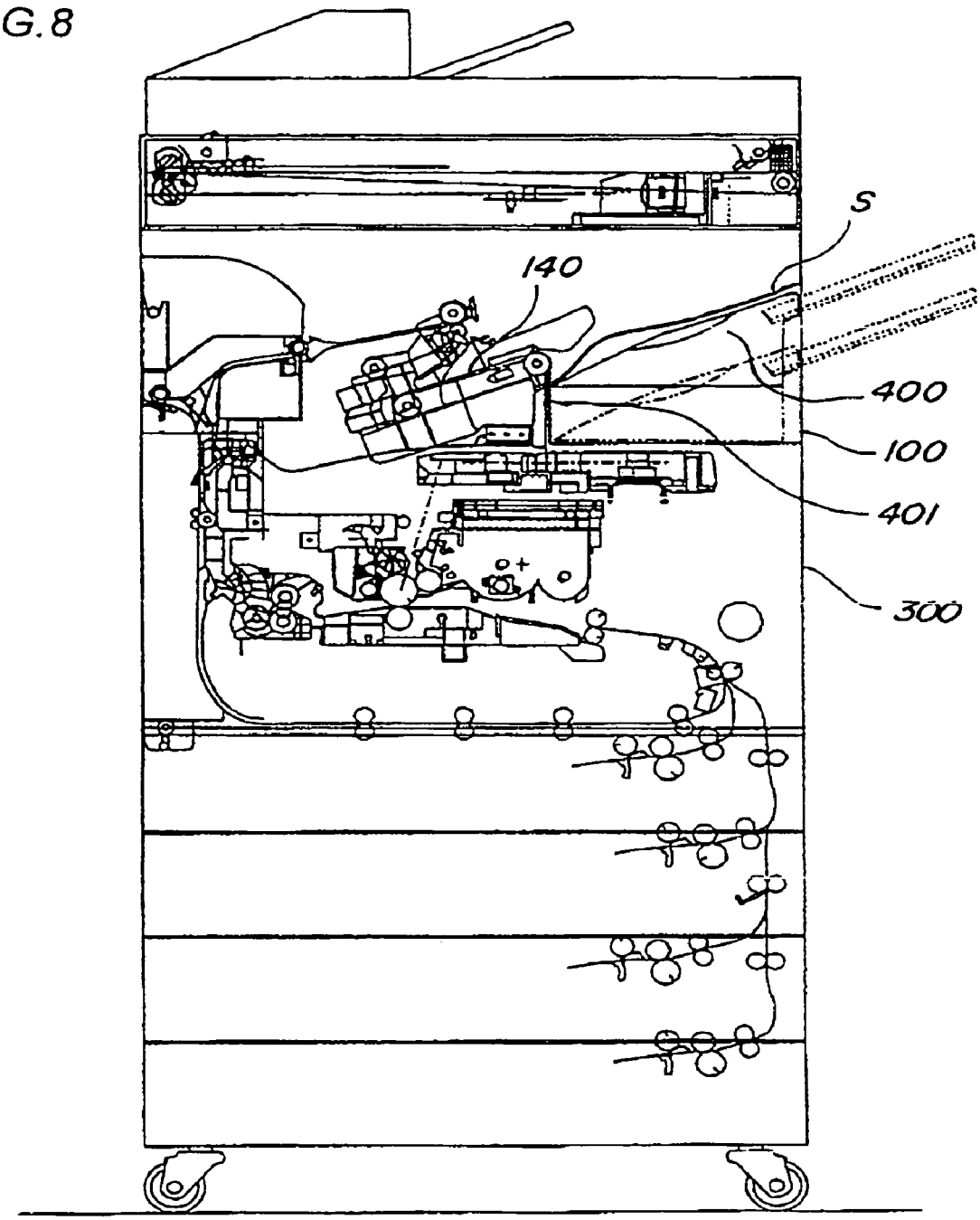
FIG. 8 is a sectional diagram of an image forming apparatus of the related art.
Figure 9:
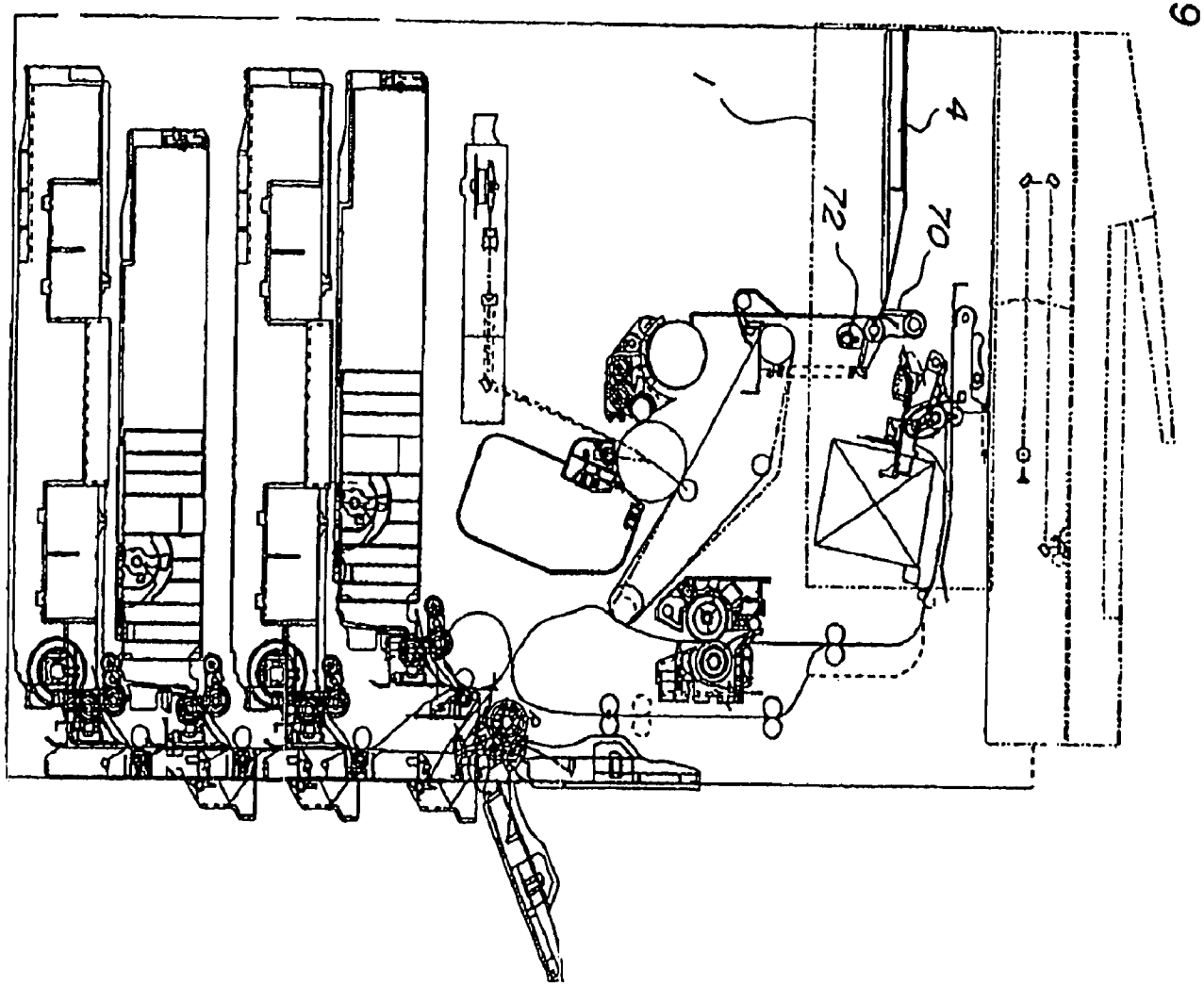
FIG. 9 is a sectional diagram of the image forming apparatus of the related art.
Figure 10A:
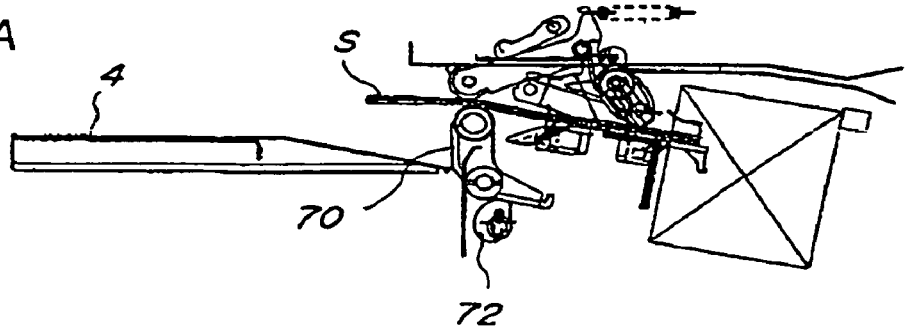
FIGS. 10A to 10D are explanatory diagrams of a sheet stacking/aligning apparatus of the related art.
Figure 10B:
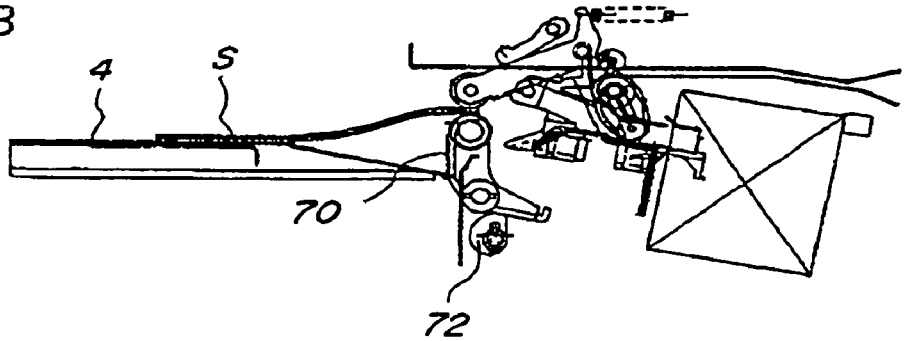
Figure 10C:
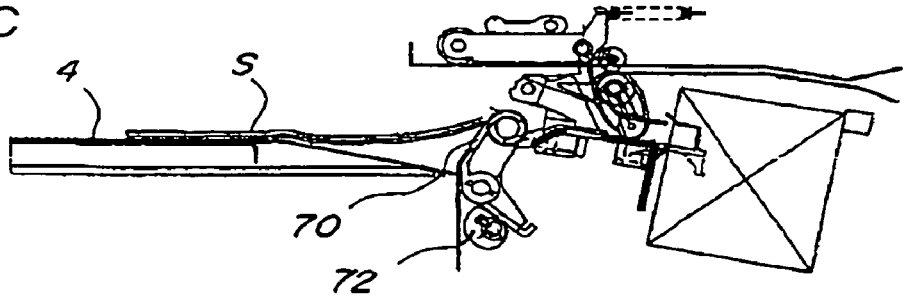
Figure 10D:
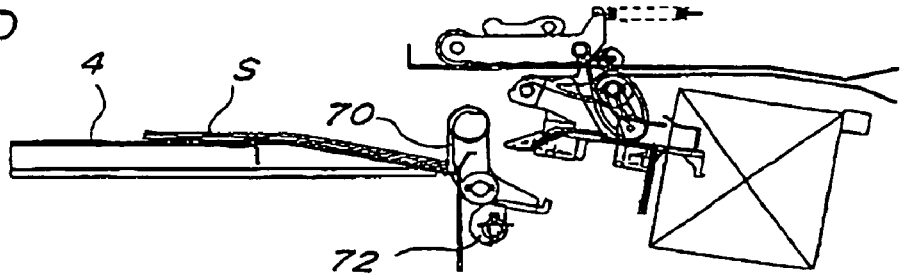

FIG. 7 is a sectional view of the sheet stacking/aligning apparatus according to the first embodiment. If the upward curl of the rear end of the sheet bundle S is excessively large, as shown in FIG. 7, the rear end of the sheets S may be pinched between the rear end aligning wall 70 and the sheet holding paddle 80.

This problem is caused by the pressure for the sheet holding paddle 80 to hold the sheet bundle. S and by the magnitude of the frictional coefficient $\mu$ of the sheet holding paddle 80 with the sheet bundle S. Specifically, the problem is caused because they are larger than the predetermined values to increase the frictional force between the sheet holding paddle 80 and the sheet bundle S so that the sheet bundle S is excessively pulled toward the rear end aligning wall 70.

When the pressure for the sheet holding paddle 80 to hold the sheet bundle S, however, it is not effectively performed to flatten the curl of the upward curled bundle and to expel the air layers between the sheets. If the frictional coefficient $\mu$ between the sheet holding paddle 80 and the sheet bundle S is smaller than that between the sheet bundle and the sheet bundle, on the other hand, the sheet bundle S can neither be effectively returned toward the rear end aligning wall 70 nor be aligned.

Therefore, the sheet stacking/aligning apparatus in this embodiment is provided with the scraper member 85 for preventing the sheet bundle from being excessively pulled while aligning the sheet bundle effectively. The scraper member 85 is made of a sheet material of a resin having a thickness t of about 0.02 to 1 mm, and has a predetermined elastic force and a frictional coefficient $\mu$ of 0.6 or less.

Figure 6A:
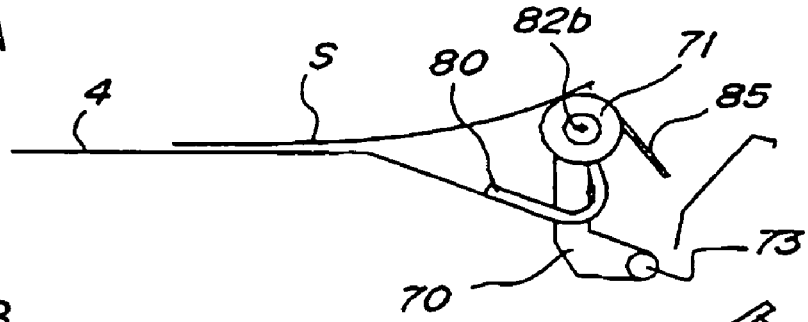
FIGS. 6A to 6E are explanatory diagrams of the sheet stacking/aligning apparatus according to the second embodiment.
Figure 6B:
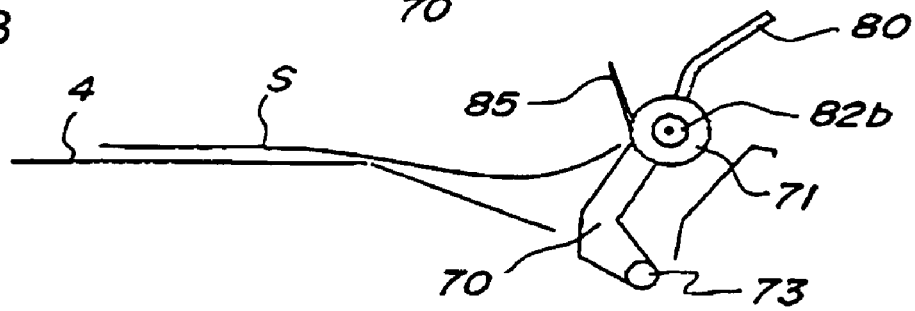
Figure 6C:
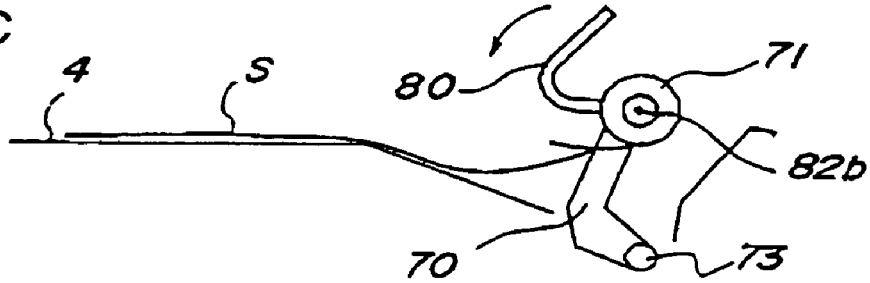
Figure 6D:
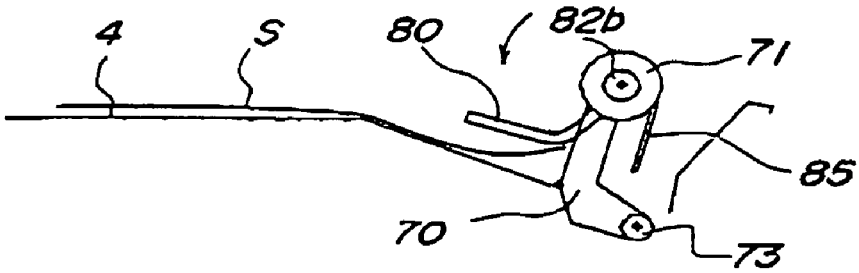
Figure 6E:
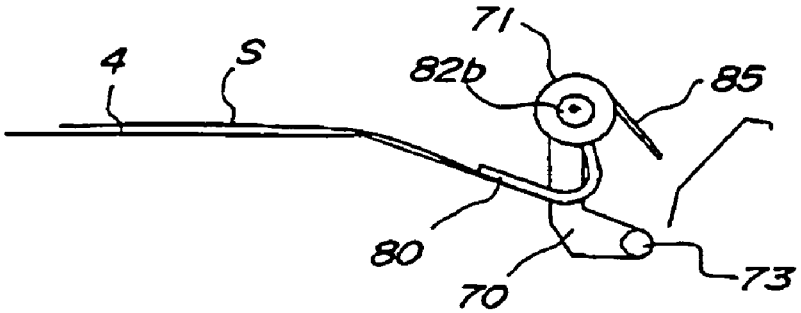

Before the operation start shown in FIG. 6A, the scraper member 85 is arranged such that it contacts with the sheet bundle before the sheet bundle holding of the sheet holding paddle 80 and turns with a predetermined phase difference from the sheet holding paddle 80. As shown in FIGS. 6B and 6C, the scraper member 85 turns with the rotation of the paddle turning shaft 90 when the drive is transmitted thereto, and scrapes off the curled rear end of the sheet bundle S toward the stack tray 4. Subsequently, the sheet holding paddle 80 comes into abutment against the rear end of the scraped sheet bundle, as shown in FIGS. 6D and 6E, the sheet holding paddle 80 comes into abutment against the rear end of the scraped sheet bundle and pulls the sheet bundle toward the rear end aligning wall 70, thus completing the stacking and alignment of the rear end of the sheet bundle.

By providing the scraper member 85 for contacting with the sheet bundle prior to the sheet bundle holding of the sheet holding paddle 80 and for turning with the predetermined phase difference from the sheet holding paddle 80, as described hereinbefore, the curl of the sheet bundle is once flattened by the scraper member 85. Therefore, even the sheet bundle having a large upward curl is not excessively pulled toward the rear end aligning wail 70 but can be stacked and aligned without fail.

As has been described hereinbefore, the sheet rear end aligning means is provided with the sheet holding means for holding the sheets stacked on the stack means. As a result, the sheet holding means can hold the curl of the sheets and expels the air layers between the sheets so that it can suppress the increase in the thickness of the sheets, as might otherwise be caused by the air layers or the curl. As a result, the space increase due to the stroke or inclination of the stack means in the height direction can be prevented without reducing the number of sheets to be stacked. Moreover, the timing to arrange the sheet rear ends on the stack means by the sheet rear end aligning means and the timing to hold the sheets with the sheet holding means can be controlled to reduce the stack failures (e.g., the folds or wrinkles) of the sheets.

What is claimed is:

1. A sheet handling apparatus, comprising:

intermediate handling means for temporarily stacking a sheet conveyed from sheet conveyance means to handle the sheet;

stack means for stacking the sheets handled;

sheet rear end aligning means capable of moving selectively to a support position at which it supports the lower face of the sheet bundle handled by said intermediate handling means, or an escape position at which it escapes from the lower face of said sheet bundle to drop said sheet bundle onto said stack means;

control means for changing the position of said sheet rear end aligning means between the support position and the escape position; and sheet holding means for holding the rear end portions of the sheets stacked on said stack means, wherein said control means makes controls so that it may cooperate to perform the sheet rear end aligning operation by said sheet rear end aligning means for moving from the escape position to the support position to align the rear end of the sheet bundle dropped on said stack means and the sheet holding operation by said sheet holding means, wherein said control means makes controls to changes the pushing force by said sheet holding means in accordance with the change in the rate of the sheet rear end aligning operation by said sheet rear end aligning means.

2. A sheet handling apparatus, comprising:

intermediate handling means for temporarily stacking a sheet conveyed from sheet conveyance means to handle the sheet;

stack means for stacking the sheets handled;

sheet rear end aligning means capable of moving selectively to a support position at which it supports the lower face of the sheet bundle handled by said intermediate handling means, or an escape position at which it escapes from the lower face of said sheet bundle to drop said sheet bundle onto said stack means;

control means for changing the position of said sheet rear end aligning means between the support position and the escape position; and sheet holding means for holding the rear end portions of the sheets stacked on said stack means, wherein said control means makes controls so that it may cooperate to perform the sheet rear end aligning operation by said sheet rear end aligning means for moving from the escape position to the support position to align the rear end of the sheet bundle dropped on said stack means and the sheet holding operation by said sheet holding means, wherein said control means makes controls:

to start the sheet holding operation by said sheet holding means at an earlier timing than that of the end of the sheet rear end aligning operation by said sheet rear end aligning means; and to end the sheet holding operation by said sheet holding means at a timing simultaneous with or later than that of the end of the sheet rear end aligning operation by said sheet rear end aligning means.

3. A sheet handling apparatus, comprising:

intermediate handling means for temporarily stacking a sheet conveyed from sheet conveyance means to handle the sheet;

stack means for stacking the sheets handled;

sheet rear end aligning means capable of moving selectively to a support position at which it supports the lower face of the sheet bundle handled by said intermediate handling means, or an escape position at which it escapes from the lower face of said sheet bundle to drop said sheet bundle onto said stack means;

control means for changing the position of said sheet rear end aligning means between the support position and the escape position;

sheet holding means for holding the rear end portions of the sheets stacked on said stack means, wherein said control means makes controls so that it may cooperate to perform the sheet rear end aligning operation by said sheet rear end aligning means for moving from the escape position to the support position to align the rear end of the sheet bundle dropped on said stack means and the sheet holding operation by said sheet holding means; and a drive unit for driving said sheet rear end aligning means and said sheet holding means with common drive means, wherein said drive unit includes:

a rocking shaft for transmitting the rotation of said drive means to support said sheet rear end aligning means in a rocking manner;

a rotary shaft for supporting said sheet holding means rotatably; and drive transmission means for transmitting the rotation of said rocking shaft to said rotary shaft, and whereby said sheet rear end aligning means is rocked according to the rotation of a cam portion provided by said rotary shaft.

4. An image forming apparatus, comprising:

an image forming unit for forming an image on a sheet;

intermediate handling means for temporarily stacking the image-formed sheet to handle the sheet;

stack means for stacking the sheets handled;

sheet rear end aligning means capable of moving selectively to a support position at which it supports the lower face of the sheet bundle handled by said intermediate handling means, or an escape position at which it escapes from the lower face of said sheet bundle to drop said sheet bundle onto said stack means;

control means for changing the position of said sheet rear end aligning means between the support position and the escape position;

sheet holding means for holding the rear end portions of the sheets stacked on said stack means, wherein said control means makes controls so that it may cooperate to perform the sheet rear end aligning operation by said sheet rear end aligning means for moving from the escape position to the support position to align the rear end of the sheet bundle dropped on said stack means and the sheet holding operation by said sheet holding means; and wherein said control means makes controls to change the pushing force by said sheet holding means in accordance with the change in the rate of the sheet rear end aligning operation by said sheet rear end aligning means.

5. An image forming apparatus, comprising:

an image forming unit for forming an image on a sheet;

intermediate handling means for temporarily stacking the image-formed sheet to handle the sheet;

stack means for stacking the sheets handled;

sheet rear end aligning means capable of moving selectively to a support position at which it supports the lower face of the sheet bundle handled by said intermediate handling means, or an escape position at which it escapes from the lower face of said sheet bundle to drop said sheet bundle onto said stack means;

control means for changing the position of said sheet rear end aligning means between the support position and the escape position;

sheet holding means for holding the rear end portions of the sheets stacked on said stack means, wherein said control means makes controls so that it may cooperate to perform the sheet rear end aligning operation by said sheet rear end aligning means for moving from the escape position to the support position to align the rear end of the sheet bundle dropped on said stack means and the sheet holding operation by said sheet holding means; and wherein said control means makes controls to generate a pushing force for said sheet holding means to push said sheet toward said sheet rear end aligning means, after said sheet rear end aligning means begins to push the rear end of said sheet.

6. An image forming apparatus, comprising:

an image forming unit for forming an image on a sheet;

intermediate handling means for temporarily stacking the image-formed sheet to handle the sheet;

stack means for stacking the sheets handled;

sheet rear end aligning means capable of moving selectively to a support position at which it supports the lower face of the sheet bundle handled by said intermediate handling means, or an escape position at which it escapes from the lower face of said sheet bundle to drop said sheet bundle onto said stack means;

control means for changing the position of said sheet rear end aligning means between the support position and the escape position;

sheet holding means for holding the rear end portions of the sheets stacked on said stack means, wherein said control means makes controls so that it may cooperate to perform the sheet rear end aligning operation by said sheet rear end aligning means for moving from the escape position to the support position to align the rear end of the sheet bundle dropped on said stack means and the sheet holding operation by said sheet holding means; and wherein said control means makes controls:

to start the sheet holding operation by said sheet holding means at an earlier timing than that of the end of the sheet rear end aligning operation by said sheet rear end aligning means; and to end the sheet holding operation by said sheet holding means at a timing simultaneous with or later than that of the end of the sheet rear end aligning operation by said sheet rear end aligning means.

7. An image forming apparatus, comprising:

an image forming unit for forming an image on a sheet;

intermediate handling means for temporarily stacking the image-formed sheet to handle the sheet;

stack means for stacking the sheets handled;

sheet rear end aligning means capable of moving selectively to a support position at which it supports the lower face of the sheet bundle handled by said intermediate handling means, or an escape position at which it escapes from the lower face of said sheet bundle to drop said sheet bundle onto said stack means;

control means for changing the position of said sheet rear end aligning means between the support position and the escape position;

sheet holding means for holding the rear end portions of the sheets stacked on said stack means, wherein said control means makes controls so that it may cooperate to perform the sheet rear end aligning operation by said sheet rear end aligning means for moving from the escape position to the support position to align the rear end of the sheet bundle dropped on said stack means and the sheet holding operation by said sheet holding means; and a drive unit for driving said sheet rear end aligning means and said sheet holding means with common drive means, wherein said drive unit includes:

a rocking shaft for transmitting the rotation of said drive means to support said sheet rear end aligning means in a rocking manner;

a rotary shaft for supporting said sheet holding means rotatably; and drive transmission means for transmitting the rotation of said rocking shaft to said rotary shaft, and whereby said sheet rear end aligning means is rocked according to the rotation of a cam portion provided by said rotary shaft.

* * * * *

UNITED STATES PATENT AND TRADEMARK OFFICE

CERTIFICATE OF CORRECTION

PATENT NO. : 7,007,948 B2
APPLICATION NO. : 10/784950
DATED : March 7, 2006
INVENTOR(S) : Daisaku Kamiya et al.

It is certified that error appears in the above-identified patent and that said Letters Patent is hereby corrected as shown below:

TITLE PAGE AT ITEM [56] RC:
Foreign Patent Documents, "2002179322 A" should read --2002-179322 A--; and "2003335449 A" should read --2003-335449 A--.

COLUMN 1:
Line 18, "a" (1st occurrence) should read --an--.

COLUMN 2:
Line 54, "operation" should read --operations--.
Line 55, "handing" should read --handling--.

COLUMN 5:
Line 20, "is" should be deleted.
Line 63, "till" should read --until--.

COLUMN 6:
Line 23, "are" should read --is--.
Line 26, "are" should read --is--.
Line 48, "till" should read --until--.

COLUMN 7:
Line 20, "are" should read --is--.
Line 27, "sheets" should read --sheet--.
Line 32, "turning" should read --turn--.

COLUMN 8:
Line 48, "face 9a" should read --face 4a--.

COLUMN 9:
Line 7, "unit 60," should read --unit 360,--.

UNITED STATES PATENT AND TRADEMARK OFFICE

CERTIFICATE OF CORRECTION

PATENT NO. : 7,007,948 B2
APPLICATION NO. : 10/784950
DATED : March 7, 2006
INVENTOR(S) : Daisaku Kamiya et al.

It is certified that error appears in the above-identified patent and that said Letters Patent is hereby corrected as shown below:

COLUMN 11:
Line 10, “bundle.” should read --bundle--.
Line 57, “wail” should read --wall--.

Signed and Sealed this

Twenty-sixth Day of September, 2006

JON W. DUDAS
*Director of the United States Patent and Trademark Office*